United States Patent [19]

Nichols

[11] Patent Number: 5,042,120

[45] Date of Patent: Aug. 27, 1991

[54] SHOE LACING SYSTEM

[75] Inventor: Steven B. Nichols, Brentwood, Calif.

[73] Assignee: K-Swiss Inc., Pacoima, Calif.

[21] Appl. No.: 444,668

[22] Filed: Dec. 1, 1989

[51] Int. Cl.[5] ..... A43B 11/00

[52] U.S. Cl. ..... 24/713.2; 24/714.9; 36/50

[58] Field of Search ..... 24/713, 713.2, 713.3, 24/713.4, 713.5, 713.6, 714, 714.6, 714.9, 170, 197; 36/50

[56] References Cited

U.S. PATENT DOCUMENTS

| | | | |
|---|---|---|---|
| 177,396 | 5/1876 | Harris | 36/50 |
| 571,749 | 11/1896 | Colton | 24/713.3 |
| 572,033 | 11/1896 | See | 24/713.5 |
| 1,390,991 | 9/1921 | Fotchuk | 36/50 |
| 1,697,833 | 1/1929 | Lane | 24/197 |
| 1,830,646 | 11/1931 | Grundlehner . | |
| 2,266,083 | 12/1941 | Rzepa | 36/50 |
| 3,085,823 | 4/1963 | De Baere . | |
| 3,546,796 | 12/1970 | Adams . | |
| 3,703,775 | 11/1972 | Gatti | 36/50 |
| 4,200,998 | 5/1980 | Adams . | |
| 4,245,408 | 1/1981 | Larsen et al. | 36/50 |
| 4,366,631 | 1/1983 | Larsen et al. . | |
| 4,538,367 | 9/1985 | Adams . | |
| 4,670,949 | 6/1987 | Autry . | |

FOREIGN PATENT DOCUMENTS

| | | |
|---|---|---|
| 193275 | 1957 | Austria . |
| 181518 | 1936 | Switzerland . |
| 7868 | 1912 | United Kingdom . |
| 366177 | 1932 | United Kingdom . |

*Primary Examiner*—Victor N. Sakran

[57] ABSTRACT

Shoes having outlying lace receivers. The receivers can be in cinch arrangement or allow the lace to freely pass. Shoes with such lace arrangements have a more snug fit. The lacing arrangement of the present invention is particularly suited for athletic shoes.

6 Claims, 2 Drawing Sheets

Fig. 1
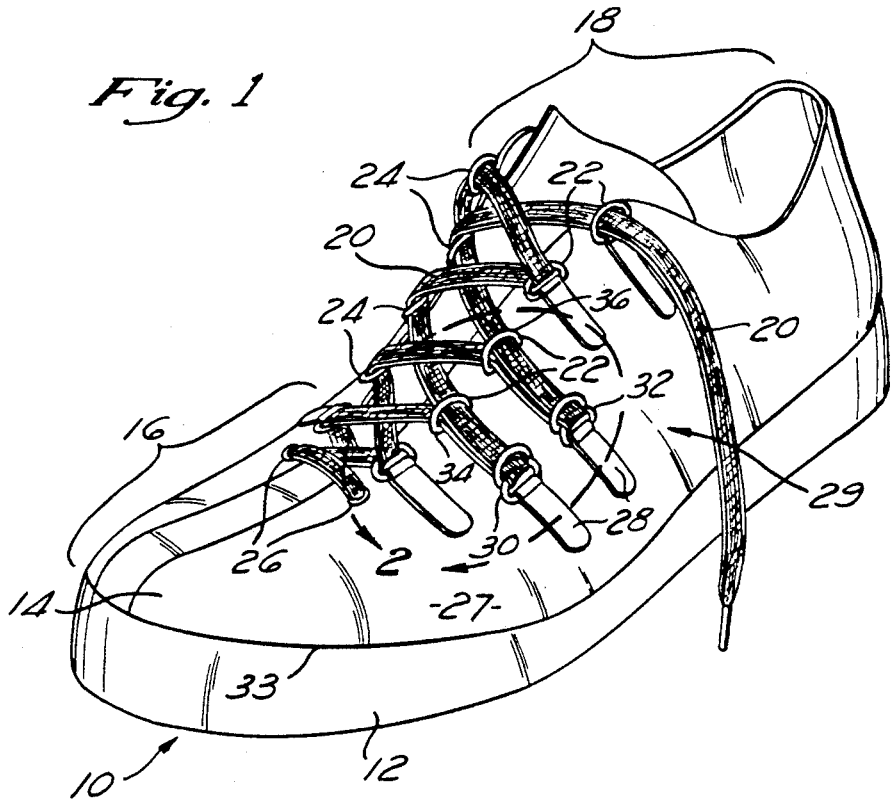
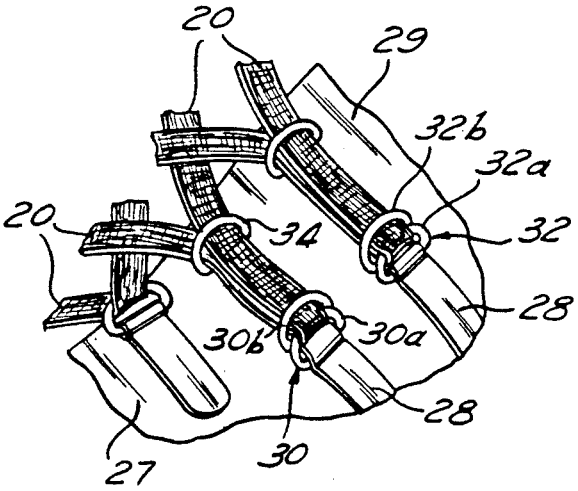
Fig. 2
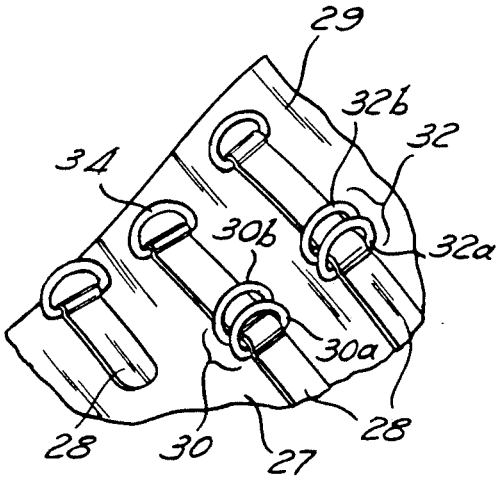
Fig. 2a

Fig. 3
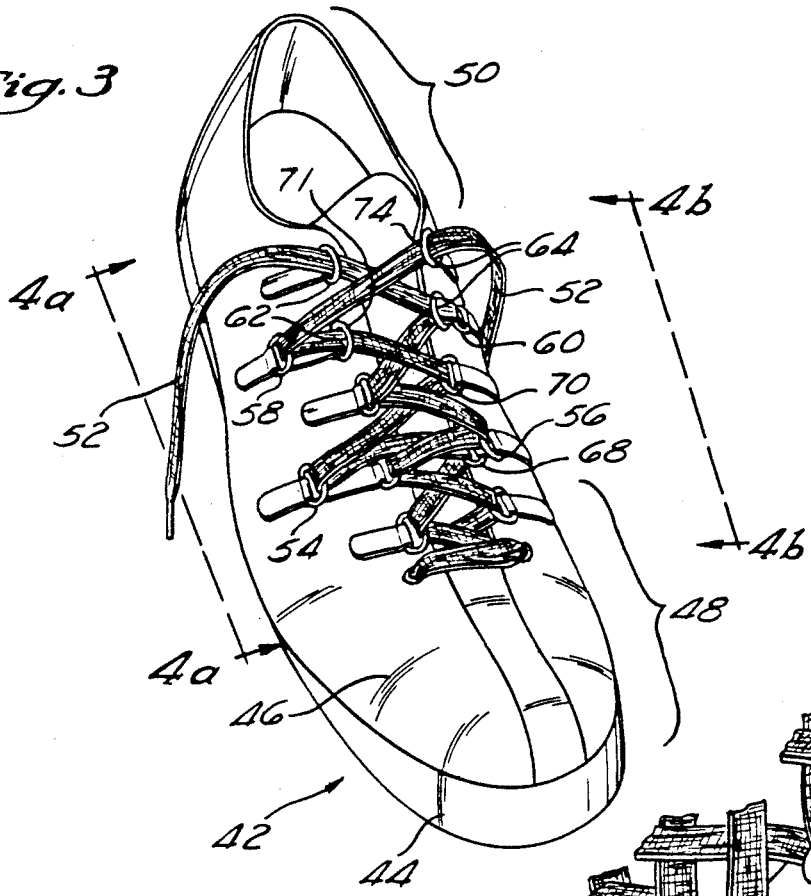
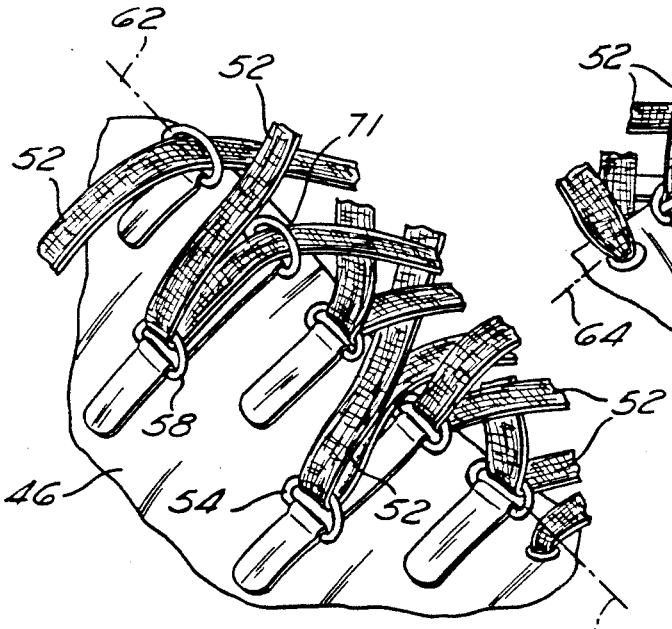
Fig. 4a
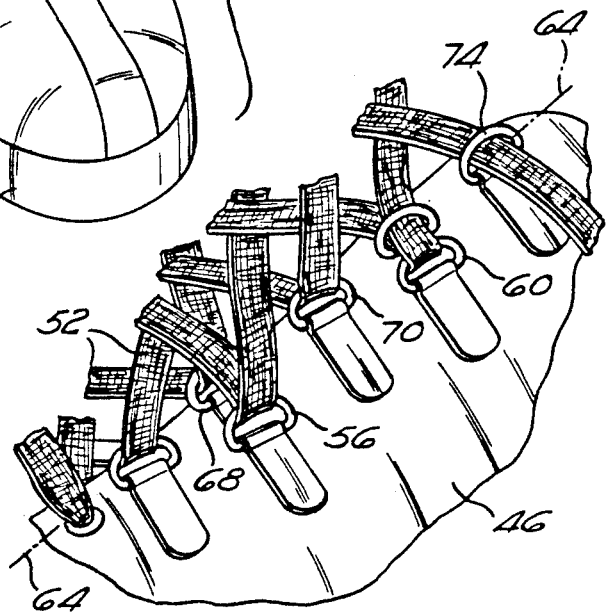
Fig. 4b

SHOE LACING SYSTEM

FIELD OF THE INVENTION

This invention relates to footwear lacing, and more particularly, to means for lacing athletic shoes.

RELEVANT ART

Shoes can be fastened onto the wearer's foot in a variety of conventional ways. Athletic shoes are conventionally laced and tied. Athletic shoes, particularly shoes to be worn for sports like tennis and basketball, present a special problem. Ideally the sole of the shoe is always in exactly the same relationship to the sole of the athlete's foot. But in sports involving lateral movement, the foot may slip slightly. Such slips can imbalance the athlete, spoiling his movement, or even causing him to fall.

It would be advantageous to have a shoe lacing system that allowed the wearer to put different amounts of tension on different portions of the lace. This would allow the user to selectively adjust the tension of the shoe around his foot, thereby creating a more snug fit.

It would be further advantageous to have lacing points closer to the sole of the shoe to provide a closer fit around the user's foot.

Various unconventional methods of shoe lacing have been used for athletic shoes before. Larsen U.S. Pat. Nos. 4,245,408 and 4,366,631 both disclose a lacing arrangement whereby the lacing means is provided along the sides of the shoe in a manner such that the heel portion of the shoe is brought inwardly. Although the heel is effectively locked into the shoe, the toes are not secured by this arrangement.

Autry U.S. Pat. No. 4,670,949 teaches a lacing arrangement whereby a single lace is staggered in an unconventional pattern. However, the resultant pattern does not grip the toes any better than the more conventional patterns.

Various means for locking lacing means into a predetermined pattern are known. Of particular interest is Adams U.S Pat. No. 4,538,367. A boot having a lace cinch point is taught. The lace cinch point, one on each side, is in line with all other lace receivers. Therefore, the shoe vamp cannot be effectively tightened around the foot, as would be possible with a cinch point lying outside of the line of lace receivers, i.e. between the line of lace receiving means and the outer sole of the shoe.

Adams U.S. Pat. No. 4,200,998 teaches a method and apparatus for locking laces on an athletic shoe having a conventional lacing arrangement.

Bostwick U.S. Pat. No. 1,095,700 teaches a method of securing lacing to avoid tieing laces at the top of the shoe.

Grundlehner U.S. Pat. No. 1,830,646 teaches an alternative method to avoid tying laces.

Adams U.S. Pat. No. 3,546,796 teaches an athletic shoe having an upper and a lower lacing means. However, each of the lace receivers is in one of two columns in substantially conventional arrangement.

De Baere U.S. Pat. No. 3,085,823 teaches a rope tie that has one loop of wire. This arrangement of tie rope, or lace in the case of shoes, is less easily used on shoes than the well known conventional double loop of double ring cinch.

Austrian Patent No. 193275, Swiss Patent No. 181518, British Patent Nos. 366177 and 7868 are known to applicant but not believed to be relevant to the claimed invention.

It would be advantageous to have an athletic shoe having a lace point that lies outside the line of lace receivers to more effectively tighten the shoe around the foot of the wearer.

SUMMARY OF THE INVENTION

This invention provides shoes having outlying lace receivers in addition to conventional double arrays of lace receivers. The receivers can be in cinch arrangement or allow the lace to freely pass. Shoes with such lace arrangements have more snug fit. The lacing arrangement of the present invention is particularly suited for athletic shoes.

An aspect of this invention is a system for receiving shoe laces comprising:

- a continuous laceable shoe having an outer sole;
- a lace for lacing said shoe;
- a first column of lace receivers;
- a second column of lace receivers;
- said first and second columns disposed along the approximate medial axis of the shoe; and
- paired, outlying, wire loop receiving means located about mid-way between the first column of lace receivers and the sole of the shoe, whereby said lace can be threaded through said lace receivers paired wire loop receiving means and selectively adjust the tension about the foot at the paired wire loop receiving means.

A further aspect of this invention is a system for lacing a shoe having a sole comprising:

- a plurality of lace receivers forming a first column of lace receivers and a second column of lace receivers each column being disposed along the approximate medial axis of the shoe; and
- paired outlying lace receiver D-ring receiver and a second D-ring receiver positioned on the outer side of the shoe approximately midway between the first column and the sole.

BRIEF DESCRIPTION OF THE DRAWINGS

FIG. 1 shows a perspective view of a left shoe showing an embodiment of the claimed invention.

FIG. 2*a* is an enlarged detail taken along arcuate line 2*a* of FIG. 1.

FIG. 2*b* shows the same detail as FIG. 2, but with laces removed.

FIG. 3 shows a perspective view of a second embodiment of this invention.

FIG. 4*a* is a fragmentary side elevational view taken along the line 4*a*—4*a* of FIG. 3; and FIG. 4*b* is a fragmentary side elevational view taken along the line 4*b*—4*b*.

DETAILED DESCRIPTION OF THE PREFERRED EMBODIMENT

Referring to FIG. 1, an athletic shoe 10, for the left foot, has a sole 12, an upper 14, a toe region 16, an ankle region 18 , and is secured on the wearer's foot by laces 20.

The shoe has, along its medial axis and adjacent the tongue, a first column or array of a plurality of wire loop lace receivers or D-rings 22 and a second column or array of a plurality of wire loop lace receivers or D-Rings 24. Herein the first plurality of lace receivers will refer to that array of lace receivers on the outer side of the medial axis of each shoe when a pair of shoes is correctly worn. The second plurality will refer to the array of lace receivers on the inner side of the medial axis of a correctly worn pair of shoes.

The lace 20 is preferably held at the toe end by two circular lace receivers or eyelets 26 cut into the leather of the shoe, and by the first array of a plurality of D-ring lace receivers 22 and a second column of a plurality of D-ring lace receivers leading to the top of the shoe. The D-ring lace receivers are held by lace receiver anchors 28 which are strips of strong material e.g. nylon looped over the D-ring and sewn to the shoe upper 29. The third and fourth lacing rows have a first outlying D-ring cinch means 30 and a second outlying D-ring cinch means 32. Each D-ring cinch means 30,32 comprises a pair of closely spaced anchored D-rings 30*a*,30*b*, and 32*a*,32*b* respectively, through which the lace 20 is passed and cinched at those points, in a conventional manner. The first D-ring cinch means 30 and the second D-ring cinch means 32 are preferably positioned on the outer vamp 27 of the upper 29, and about half way between the first column 22 of a plurality of lace receivers and the line 33 formed by the junction of the sole of the shoe with the upper.

Referring now to FIGS. 2 and 2*a*, it will be seen that lace 20 passes through D-ring 34 (located on the outer medial axis of the shoe upper 29) and then through both D-rings 30*a*,30*b*. The lace 20 is then doubled back over D-ring 30*a* and through D-ring 30*b* whereby lace 20 is cinched at the area of the cinching means 30 to secure the toe section of the shoe around the wearer as snugly as desired. The lace 20 then continues through D-ring 34, and a second cinching area may be engaged by cinching means 32 in the same manner as just described with reference to cinching means 30.

Normally when both cinch means 30,32 are tight, the lace received in the toe region will not move even when the laces in the upper portion are moved. The continuous lace 20 in the toe portion can be made tighter or looser than the laces in the top portion that laces over the wearer's instep.

Because the outlying D-ring cinch means 30,32 are disposed only on the outer vamp 27 of the shoe upper 29, when one wears a pair of shoes having the cinch means 30,32, the two pairs of cinch means, one on each shoe, will not contact each other in normal use. This avoids the possibility that the two pairs of cinch means, if placed on the inner side of the vamp 27, might inadvertently interlock thereby tripping the user. The cinch means 30,32 may comprise very closely space D-rings 30*a*,30*b*, or 32*a*,32*b* as shown, or the cinch means may comprise D-rings, or other wire loop members spaced further apart, e.g. up to about 0.75" apart.

Referring to FIG. 3, a right athletic shoe 42 has a sole 44, an upper 46, a toe region 48, and ankle region 50, and is secured to the wearer's foot by a continuous lace 52. Outlying wire loops or D-rings 54 and 56 are provided in the third lacing row of lace receivers. Outlying wire loops or D-rings 58 and 60 are also provided in the fifth lacing row.

Referring to 4*a* and 4*b*, the outlying D-ring 54 receives a lace 52 that has passed through the third lacing row D-ring 68 of the lacing column 64. The lace is then passed through the D-ring 54 to D-ring 70 in the fourth lacing row of column 64. The second outlying D-ring 58 receives the lace after it has passed through the fourth lacing row receivers 70,71. The lace is then passed through D-ring 74 in the second column 64.

It should be appreciated that the lace can be threaded through the D-rings in a wide variety of ways. Different users may prefer different lacing patterns.

The lace is not secured or cinched at the outlying D-rings 54,56,58, and 60, but rather fed through like any other lace receiving D-ring. However, the outlying position of the D-rings 54,56,58, and 60 providing lacing, or tightening, points closer to the sole than conventional lacing arrangements allow, and allows the snuggest-fit to be made, as desired by the wearer.

Referring to FIG. 4*b* the D-rings 56 and 60 are disposed outlying from the second column of D-rings 64, but not as remotely outlying as the D-rings 54,58 so that there will be no interference from D-rings similarly placed on an inner column of the mating shoe. The lace 52 is not cinched at any point in this embodiment but instead the lace moves freely through the outlying D-rings, 56,60.

It is important to note that the particular lacing pattern is not critical. Rather the invention lies in the placement of the lace receivers outlying the normal columns of 62,64 of lace receivers nearer to the shoe sole. The laces can be standard cotton laces used for athletic shoes, or other laces known and used.

It should be noted that although FIG. 1 shows a left shoe and FIG. 3 shows a right shoe, the two lacing pattern are not necessarily contemplated as showing the way to lace each shoe in a pair. Rather, it is contemplated that in normal use a pair of shoes would use one of the two lacing systems.

Although the lacing patterns taught herein are particularly useful for athletic shoes, other types of shoes can benefit from the outlying lace receivers as described herein.

I claim:

1. A system for lacing a shoe having a sole, a shoe vamp, and inner and outer shoe edges, which comprises:

a lace for lacing said shoe;

a first column of lace receivers;

a second column of lace receivers;

said first and second columns of lace receivers disposed along the medial axis of the shoe, said first column being adjacent the outer edge of the shoe, and the said second column being remote from the said outer edge of the shoe; and at least two separate and independent outlying wire loop lace receiving means spacedly located between the said first column of lace receivers and the sole of the shoe, each such spaced outlying wire loop lace receiving means being separately and independently anchored to said shoe vamp whereby said lace is threadable through at least one of said outlying wire loop lace receiving means to selectively adjust the tension about the foot at the area of the outlying wire loop lace receiving means through which said lace is threaded.

2. The lacing system of claim 1 wherein at least one of said wire loop lace receiving means includes a single wire loop.

3. The lacing system of claim 1 wherein at least one of said wire loop receiving means includes a single D-ring.

4. The lacing system of claim 1 wherein at least one of said wire loop receiving means includes a pair of closely spaced wire loops for cinching of the lace at the area of said closely spaced wire loop lace receiving means.

5. The lacing system of claim 1 wherein at least one of said wire loop receiving means includes a pair of closely spaced D-rings, disposed along an axis generally perpendicular to the said medial axis, for cinching said lace at the area of said closely spaced D-rings.

6. A system for lacing a shoe having a sole, and a shoe vamp which comprises:

a lace for lacing said shoe;

a first column for lacing receivers;

a second column of lace receivers;

said first and second columns of lace receivers disposed along the medial axis of the shoe;

at least two separate and independent outlying wire loop lace receiving means spacedly located between the said first or second column of lace receivers and the sole of the shoe, each such spaced outlying wire loop lace receiving means being separately and independently anchored to said shoe vamp whereby said lace is threadable through at least one of said outlying wire loop lace receiving means to selectively adjust the tension about the foot at the area of the outlying wire loop lace receiving means through which said lace is threaded; and at least one of said wire loop receiving means including a pair of closely spaced D-ring members cinching the lace at the area of said D-ring members.

* * * * *